US010908548B2

(12) United States Patent
Tzomik et al.

(10) Patent No.: US 10,908,548 B2
(45) Date of Patent: Feb. 2, 2021

(54) SELECTIVE PRINTING

(71) Applicant: HP Indigo B.V., Amstelveen (NL)

(72) Inventors: Inna Tzomik, Nes Ziona (IL); Hannoch Ron, Nes Ziona (IL); Gleb Romantcov, Nes Ziona (IL); Faina Kogan, Nes Ziona (IL); Sergio Brandriss, Nes Ziona (IL)

(73) Assignee: HP Indigo B.V., Amstelveen (NL)

( * ) Notice: Subject to any disclaimer, the term of this patent is extended or adjusted under 35 U.S.C. 154(b) by 197 days.

(21) Appl. No.: 16/063,853

(22) PCT Filed: Mar. 2, 2016

(86) PCT No.: PCT/EP2016/054479

§ 371 (c)(1),
(2) Date: Jun. 19, 2018

(87) PCT Pub. No.: WO2017/148515

PCT Pub. Date: Sep. 8, 2017

(65) Prior Publication Data

US 2018/0373193 A1 Dec. 27, 2018

(51) Int. Cl.

| | |
|---|---|
| ***G03G 15/00*** | (2006.01) |
| ***G03G 15/10*** | (2006.01) |
| ***G03G 13/10*** | (2006.01) |
| ***G03G 8/00*** | (2006.01) |

(52) U.S. Cl.

CPC ..... *G03G 15/6582* (2013.01); *G03G 8/00* (2013.01); *G03G 13/10* (2013.01); *G03G 15/10* (2013.01); *G03G 15/6591* (2013.01); *G03G 2215/00502* (2013.01); *G03G 2215/00873* (2013.01)

(58) Field of Classification Search

CPC ..... G03G 15/6582; G03G 13/10; G03G 15/10
USPC ..... 430/117.2, 117.3
See application file for complete search history.

(56) References Cited

U.S. PATENT DOCUMENTS

| | | | |
|---|---|---|---|
| 8,088,492 | B2 | 1/2012 | Huynh |
| 8,198,353 | B2 | 6/2012 | Cooper |
| 2008/0160435 | A1 | 7/2008 | Lim et al. |
| 2010/0075113 | A1 | 3/2010 | Schumacher et al. |

(Continued)

FOREIGN PATENT DOCUMENTS

| | | |
|---|---|---|
| CN | 101211130 | 7/2008 |
| CN | 101421114 | 6/2015 |
| CN | 1047736345 | 6/2015 |

(Continued)

OTHER PUBLICATIONS

International Search Report dated Nov. 17, 2016 for PCT/EP2016/054479, Applicant Hewlett-Packard Indigo B.V.

*Primary Examiner* — Mark A Chapman
(74) *Attorney, Agent, or Firm* — Thorpe North & Western LLP

(57) ABSTRACT

The present disclosure relates to a process for selectively printing an image onto a substrate. The process comprises electrophotographically printing a first ink composition onto selected areas of a substrate. The process also comprises applying a primer over at least the unprinted areas of the substrate. A second ink composition is printed onto the primer and the first ink composition is removed from the selected areas of the substrate. The first ink composition is a transparent electrophotographic ink composition.

16 Claims, 1 Drawing Sheet

(56) References Cited

U.S. PATENT DOCUMENTS

| | | | | |
|---|---|---|---|---|
| 2013/0161322 | A1 | 6/2013 | Li et al. | |
| 2016/0370726 | A1* | 12/2016 | Zhao | G03G 9/122 |

FOREIGN PATENT DOCUMENTS

| | | |
|---|---|---|
| JP | S61185488 | 8/1986 |
| JP | S62255186 | 11/1987 |
| JP | H01192598 | 8/1989 |
| JP | H03221486 | 9/1991 |
| JP | H0564962 | 3/1993 |
| JP | H10193885 | 7/1998 |
| JP | 2005238447 | 9/2005 |
| JP | 2009526664 | 7/2009 |
| JP | 2011136578 | 7/2011 |
| JP | 2012141599 | 7/2012 |
| JP | 2012192706 | 10/2012 |
| JP | 2012234116 | 11/2012 |
| JP | 2013022754 | 2/2013 |
| JP | 5203065 | 6/2013 |
| JP | 2013193321 | 9/2013 |
| JP | 2013246281 | 12/2013 |
| JP | 2015027774 | 2/2015 |
| WO | 2011079067 | 6/2011 |
| WO | 2015023262 | 2/2015 |
| WO | 2015114070 | 8/2015 |
| WO | 2017067606 | 4/2017 |

* cited by examiner

SELECTIVE PRINTING

BACKGROUND

In a printing process, ink is printed onto a substrate to form an image. The durability of the image may depend on the strength of the bond between the ink and the substrate. Some inks do not adhere effectively to certain substrates, for example, polymeric films. To improve adhesion, primers can be used to enhance the bond between ink and substrate. For example, a polymer film may be coated with a primer prior to printing to improve the adhesion of the ink onto the polymeric film. The primer may be applied, for example, by gravure coating. The ink may then be printed onto the primed substrate.

Once printed, the film may be used to produce a variety of products, including flexible packaging (e.g. shrink sleeves).

BRIEF DESCRIPTION OF THE DRAWINGS

Various implementations are described, by way of example, with reference to the accompanying drawings, in which.

DETAILED DESCRIPTION

Figure 1:
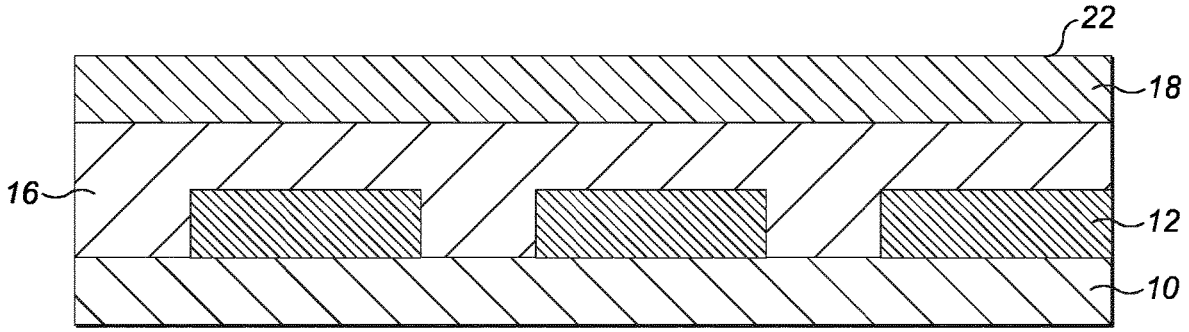
FIG. 1 is a schematic diagram showing the layers that may be applied onto a substrate in order to perform a process for selectively printing an image onto a substrate according to one example of the present disclosure.

Before the present disclosure is described, it is to be understood that this disclosure is not limited to the particular process steps and materials disclosed in this description because such process steps and materials may vary. It is also to be understood that the terminology used in this disclosure is used for the purpose of describing particular examples. The terms are not intended to be limiting.

It is noted that, as used in this specification and the appended claims, the singular forms "a," "an," and "the" include plural referents unless the context clearly dictates otherwise.

As used in this disclosure, "co-polymer" refers to a polymer that is polymerized from at least two monomers. The term "terpolymer" refers to a polymer that is polymerized from 3 monomers.

As used in this disclosure, "melt index" and "melt flow rate" are used interchangeably. The "melt index" or "melt flow rate" refers to the extrusion rate of a resin through an orifice of defined dimensions at a specified temperature and load, reported as temperature/load, e.g. 190° C./2.16 kg. In the present disclosure, "melt flow rate" or "melt index" is measured per ASTM D1238-04c Standard Test Method for Melt Flow Rates of Thermoplastics by Extrusion Plastometer. If a melt flow rate of a particular polymer is specified, unless otherwise stated, it is the melt flow rate for that polymer alone, in the absence of any of the other components of the electrophotographic or electrostatic composition.

As used in this disclosure, "acidity," "acid number," or "acid value" refers to the mass of potassium hydroxide (KOH) in milligrams that neutralizes one gram of a substance. The acidity of a polymer can be measured according to standard techniques, for example as described in ASTM D1386. If the acidity of a particular polymer is specified, unless otherwise stated, it is the acidity for that polymer alone, in the absence of any of the other components of the liquid toner composition.

As used in this disclosure, "melt viscosity" refers to the ratio of shear stress to shear rate at a given shear stress or shear rate. Testing may be performed using a capillary rheometer. A plastic charge is heated in the rheometer barrel and is forced through a die with a plunger. The plunger is pushed either by a constant force or at constant rate depending on the equipment. Measurements are taken once the system has reached steady-state operation. One method used is measuring Brookfield viscosity @ 140° C., units are mPa-s or cPoise, as known in the art. Alternatively, the melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 Hz shear rate. If the melt viscosity of a particular polymer is specified, unless otherwise stated, it is the melt viscosity for that polymer alone, in the absence of any of the other components of the electrostatic or electrophotographic composition.

A polymer may be described as comprising a certain weight percentage of monomer. This weight percentage is indicative of the repeating units formed from that monomer in the polymer.

If a standard test is mentioned in this disclosure, unless otherwise stated, the version of the test to be referred to is the most recent at the time of filing this patent application.

As used in this disclosure, "electrostatic" or "electrophotographic" are used interchangeably. An "electrostatic" or "electrophotographic" printing process refers to a process that provides an image that is transferred from a photoconductive surface or photo imaging plate either directly or indirectly via an intermediate transfer member to a print substrate. As such, the image may not be substantially absorbed into the photo imaging substrate on which it is applied. Additionally, "electrophotographic printers" or "electrostatic printers" refer to those printers capable of performing electrophotographic printing or electrostatic printing, as described above. An electrophotographic printing process may involve subjecting the electrophotographic composition to an electric field, e.g. an electric field having a field gradient of 1-400V/μm, or more, in some examples 600-900V/μm, or more.

As used in this disclosure, the term "about" is used to provide flexibility to a numerical value or range endpoint by providing that a given value may be a little above or a little below the endpoint to allow for variation in test methods or apparatus. The degree of flexibility of this term can be dictated by the particular variable and would be within the knowledge of those skilled in the art to determine based on experience and the associated description in this disclosure.

As used in this disclosure, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented in this disclosure in a range format. It is to be understood that such a range format is used merely for convenience and brevity and thus should be interpreted flexibly to include not just the numerical values explicitly recited as the limits of the range, but also to include all the individual numerical values or sub-ranges encompassed within that range as if each numerical value and sub-range is explicitly recited. As an illustration, a numerical range of "about 1 wt % to about 5 wt %" should be interpreted to include not just the explicitly recited values of about 1 wt % to about 5 wt %, but also include individual values and subranges within the indicated range. Thus, included in this numerical range are individual values such as 2, 3.5, and 4 and sub-ranges such as from 1-3, from 2-4, and from 3-5. This same principle applies to ranges reciting a single numerical value. Furthermore, such an interpretation should apply regardless of the breadth of the range or the characteristics being described.

The present disclosure relates to a process for selectively printing an image onto a substrate. The process comprises electrophotographically printing a first ink composition onto selected areas of a substrate. The process also comprises applying a primer over at least the unprinted areas of the substrate. A second ink composition is printed onto the primer and the first ink composition is removed from the selected areas of the substrate. The first ink composition is a transparent electrophotographic ink composition.

It has been found that, while primers can be used to enhance the adhesion of an ink to a substrate, they can adhere strongly to the substrate themselves. Any exposed primer left on the substrate, therefore, may interfere with the subsequent processing of the substrate. For example, in the case of a polymer film substrate intended for use as a shrink sleeve, the presence of residual primer can interfere with the wetting properties of the polymer, which, in turn, can adversely affect downstream processing steps, such as seam and/or seal formation.

The present inventors have found that, by electrophotographically printing a transparent electrophotographic ink composition onto selected areas of the substrate, it is possible to protect those selected areas of the substrate from direct contact with the primer. Primer may then be applied at least to the unprinted areas of the substrate and a second ink composition applied over the primer. Thereafter, the transparent electrophotographic ink may be removed from the substrate. This can be carried out, for example, by peeling or thermal transfer. Any primer or second ink composition present over the transparent electrophotographic ink in the selected areas may also be removed. In this way, any exposed primer may be removed from the substrate. The substrate may then be further processed with a reduced risk of residual primer interfering with any subsequent processing steps.

In one example, the transparent electrophotographic ink may be removed from selected areas of the substrate by thermal transfer. For instance, the substrate may be contacted with a further substrate. Heat and, for example, pressure may be applied in order to transfer the transparent electrophotographic ink and any primer and/or second ink composition covering the selected areas of the substrate onto the further substrate. In this way, the further substrate may become imprinted with an image comprising a layer of the second ink composition, a layer of primer disposed over the layer of the second ink composition and a layer of the first electrophotographic ink composition disposed over the layer of primer. In one example, the further substrate is processed further, for example, to form packaging or other articles.

In a further aspect, the present disclosure relates to a substrate that is printed with an image comprising a first layer of electrophotographic ink comprising a colorant, a second layer of primer disposed over the first layer of electrophotographic ink, and a third later of a transparent electrophotographic ink disposed over the second layer of primer.

Selective Printing

The selective printing process of the present disclosure will now be described by way of example with reference to FIGS. 1 to 3 of the drawings.

FIG. 1 is a schematic diagram of a substrate (10). The substrate (10) may be electrophotographically printed with a transparent electrophotographic ink composition (12) in selected areas of the substrate (10). A primer (14) may then be applied to at least the unprinted areas (16) of the substrate (10). In the example of FIG. 1, the primer (14) is applied to the unprinted areas (16) of the substrate (10) as well as over the selected areas of substrate printed imprinted with the transparent electrophotographic ink composition (12). Once applied, the primer may be allowed to dry, optionally with the application of heat.

A second ink composition (18), for example, an electrophotographic ink composition comprising a colorant, may be applied to the primer (14). The primer may enhance the adhesion between the second ink composition (18) and the substrate (10), resulting in a more durable image.

The transparent electrophotographic ink may then be removed from the selected areas of the substrate, for example, by thermal transfer. In this technique, a further substrate (20) (see FIG. 3) may be contacted with the printed surface (22) of the substrate (10). In some examples, the transparent electrophotographic ink composition (12) may only form a relatively weak bond with the substrate (10), allowing the transparent electrophotographic ink composition (12) to be conveniently removed. In some examples, this bond may be weakened by application of heat e.g. as the resins in the transparent electrophotographic ink soften. Thus, when heat or heat and pressure is applied, the transparent electrophotographic ink becomes detached from the substrate (10), allowing any overlying primer (14) and second ink composition (18) to transfer onto the further substrate (20).

Figure 2:
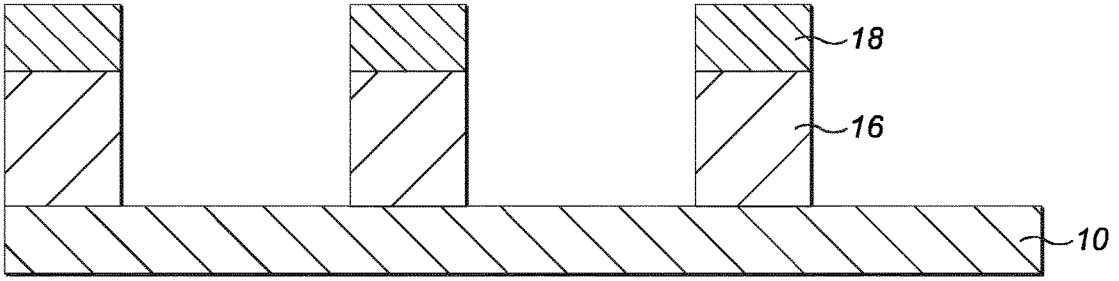
FIG. 2 is a schematic diagram of a selectively printed substrate that may be formed as a result of an example of the process of the present disclosure.
Figure 3:
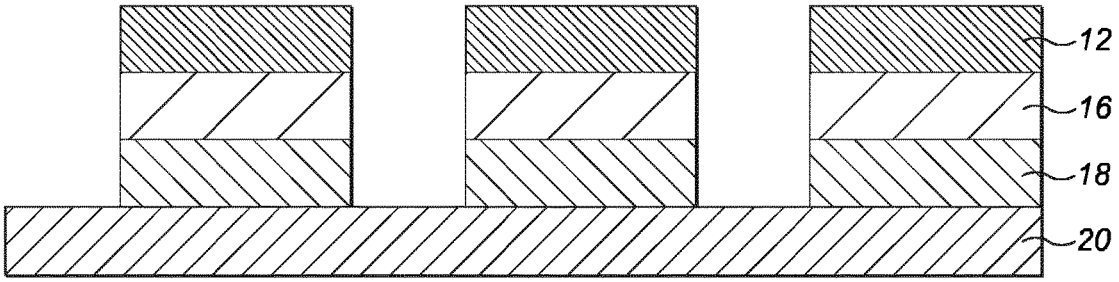
FIG. 3 is a schematic diagram of a selectively printed further substrate that may be formed as a result of an example of the process of the present disclosure.

FIG. 2 is a schematic drawing of what may remain on the substrate (10) once thermal transfer takes place. FIG. 3 is a schematic drawing of what may be transferred onto the further substrate (20) once thermal transfer takes place. It can be seen that the further substrate (20) includes an image comprising a layer of the second ink composition (18), a layer of the primer (14) disposed over the layer of the second ink composition (18) and a layer of the transparent electrophotographic ink (12) disposed over the layer of primer (14). In some examples, the primer may be transparent, allowing the second ink composition (18) to be visible through the primer (14) and the transparent electrophotographic layer (12). Depending on the final application, either or both the selectively printed substrates (10) and (20) may be further processed into articles, for example, packaging.

Electrophotographic Ink Composition

An electrophotographic ink composition is an ink composition that can be printed onto a substrate by an electrophotographic printing process. In the present disclosure, the first ink composition is a transparent electrophotographic ink composition. The transparent electrophotographic ink composition may be liquid. In some examples, the second ink composition may also be an electrophotographic ink composition, for instance, a liquid electrophotographic ink composition. A liquid electrophotographic ink composition may comprise a thermoplastic resin dispersed in a liquid carrier. The liquid electrophotographic ink composition may also include a charge director and/or a charge adjuvant. In the case of a transparent liquid electrophotographic ink composition, the composition may be devoid of colorant. The transparent liquid electrophotographic composition may contain a solid polar compound. Where the second ink composition is a liquid electrophotographic composition, the composition may include a colorant.

Thermoplastic Resin

As described above, an electrophotographic ink composition may comprise a thermoplastic resin. The thermoplastic resin may be a polymer of an alkylene (e.g. ethylene) and at least one of methacrylic acid or acrylic acid. In some examples, the thermoplastic resin comprises a first polymer of an alkylene (e.g. ethylene) and methacrylic acid and a second polymer of alkylene (e.g. ethylene) and acrylic acid. The ratio of the first polymer to the second polymer may be 1:1 to 10:1, for example, 2:1 to 8:1. In one example, ratio of the first polymer to the second polymer may be 3:1 to 6:1, for instance, 4:1 to 5:1. In one example, the transparent electrophotographic ink composition comprises a thermoplastic resin comprising a first copolymer of ethylene and methacrylic acid and a second copolymer of ethylene and acrylic acid. The ratio of the first polymer to the second polymer may be 1:1 to 10:1, for example, 2:1 to 8:1. In one example, ratio of the first polymer to the second polymer may be 3:1 to 6:1, for instance, 4:1 to 5:1. In one example, the first copolymer is a copolymer of ethylene and methacrylic acid sold under the trademark Nucrel® 699 (DuPont). In one example, the second copolymer is a copolymer of ethylene and acrylic acid sold under the trademark AC-5120 (Honeywell®).

In some examples, the thermoplastic resin may be a polymer selected from ethylene or propylene acrylic acid co-polymers; ethylene or propylene methacrylic acid co-polymers; ethylene vinyl acetate co-polymers; co-polymers of ethylene or propylene (e.g. 80 wt % to 99.9 wt %) and alkyl (e.g. C1 to C5) esters of methacrylic or acrylic acid (e.g. 0.1 wt % to 20 wt %); co-polymers of ethylene (e.g. 80 wt % to 99.9 wt %), acrylic or methacrylic acid (e.g. 0.1 wt % to 20.0 wt %) and alkyl (e.g. C1 to C5) esters of methacrylic or acrylic acid (e.g. 0.1 wt % to 20 wt %); co-polymers of ethylene or propylene (e.g. 70 wt % to 99.9 wt %) and maleic anhydride (e.g. 0.1 wt % to 30 wt %); polyethylene; polystyrene; isotactic polypropylene (crystalline); co-polymers of ethylene and ethyl acrylate; polyesters; polyvinyl toluene; polyamides; styrene/butadiene co-polymers; epoxy resins; acrylic resins (e.g. co-polymer of acrylic or methacrylic acid and at least one alkyl ester of acrylic or methacrylic acid wherein alkyl may have from 1 to about 20 carbon atoms, such as methyl methacrylate (e.g. 50% to 90%)/methacrylic acid (e.g. 0 wt % to 20 wt %)/ethylhexylacrylate (e.g. 10 wt % to 50 wt %)); ethylene-acrylate terpolymers: ethylene-acrylic esters-maleic anhydride (MAH) or glycidyl methacrylate (GMA) terpolymers; ethylene-acrylic acid ionomers and combinations thereof.

The resin may comprise a polymer having acidic side groups. The polymer having acidic side groups may have an acidity of 50 mg KOH/g or more, in some examples an acidity of 60 mg KOH/g or more, in some examples an acidity of 70 mg KOH/g or more, in some examples an acidity of 80 mg KOH/g or more, in some examples an acidity of 90 mg KOH/g or more, in some examples an acidity of 100 mg KOH/g or more, in some examples an acidity of 105 mg KOH/g or more, in some examples 110 mg KOH/g or more, in some examples 115 mg KOH/g or more. The polymer having acidic side groups may have an acidity of 200 mg KOH/g or less, in some examples 190 mg or less, in some examples 180 mg or less, in some examples 130 mg KOH/g or less, in some examples 120 mg KOH/g or less. Acidity of a polymer, as measured in mg KOH/g can be measured using standard procedures known in the art, for example using the procedure described in ASTM D1386.

The resin may comprise a polymer, in some examples a polymer having acidic side groups, that has a melt flow rate of less than about 70 g/10 minutes, in some examples about 60 g/10 minutes or less, in some examples about 50 g/10 minutes or less, in some examples about 40 g/10 minutes or less, in some examples 30 g/10 minutes or less, in some examples 20 g/10 minutes or less, in some examples 10 g/10 minutes or less. In some examples, all polymers having acidic side groups and/or ester groups in the particles each individually have a melt flow rate of less than 90 g/10 minutes, 80 g/10 minutes or less, in some examples 80 g/10 minutes or less, in some examples 70 g/10 minutes or less, in some examples 70 g/10 minutes or less, in some examples 60 g/10 minutes or less.

The polymer having acidic side groups can have a melt flow rate of about 10 g/10 minutes to about 120 g/10 minutes, in some examples about 10 g/10 minutes to about 70 g/10 minutes, in some examples about 10 g/10 minutes to 40 g/10 minutes, in some examples 20 g/10 minutes to 30 g/10 minutes. The polymer having acidic side groups can have a melt flow rate of, in some examples, about 50 g/10 minutes to about 120 g/10 minutes, in some examples 60 g/10 minutes to about 100 g/10 minutes. The melt flow rate can be measured using standard procedures known in the art, for example as described in ASTM D1238.

The acidic side groups may be in free acid form or may be in the form of an anion and associated with one or more counterions, typically metal counterions, e.g. a metal selected from the alkali metals, such as lithium, sodium and potassium, alkali earth metals, such as magnesium or calcium, and transition metals, such as zinc. The polymer having acidic sides groups can be selected from resins such as co-polymers of ethylene and an ethylenically unsaturated acid of either acrylic acid or methacrylic acid; and ionomers thereof, such as methacrylic acid and ethylene-acrylic or methacrylic acid co-polymers which are at least partially neutralized with metal ions (e.g. Zn, Na, Li) such as SURLYN® ionomers. The polymer comprising acidic side groups can be a co-polymer of ethylene and an ethylenically unsaturated acid of either acrylic or methacrylic acid, where the ethylenically unsaturated acid of either acrylic or methacrylic acid constitute from 5 wt % to about 25 wt % of the co-polymer, in some examples from 10 wt % to about 20 wt % of the co-polymer.

The resin may comprise two different polymers having acidic side groups. The two polymers having acidic side groups may have different acidities, which may fall within the ranges mentioned above. The resin may comprise a first polymer having acidic side groups that has an acidity of from 10 mg KOH/g to 110 mg KOH/g, in some examples 20 mg KOH/g to 110 mg KOH/g, in some examples 30 mg KOH/g to 110 mg KOH/g, in some examples 50 mg KOH/g to 110 mg KOH/g, and a second polymer having acidic side groups that has an acidity of 110 mg KOH/g to 130 mg KOH/g.

The resin may comprise two different polymers having acidic side groups: a first polymer having acidic side groups that has a melt flow rate of about 10 g/10 minutes to about 50 g/10 minutes and an acidity of from 10 mg KOH/g to 110 mg KOH/g, in some examples 20 mg KOH/g to 110 mg KOH/g, in some examples 30 mg KOH/g to 110 mg KOH/g, in some examples 50 mg KOH/g to 110 mg KOH/g, and a second polymer having acidic side groups that has a melt flow rate of about 50 g/10 minutes to about 120 g/10 minutes and an acidity of 110 mg KOH/g to 130 mg KOH/g. The first and second polymers may be absent of ester groups.

The ratio of the first polymer having acidic side groups to the second polymer having acidic side groups can be from about 10:1 to about 2:1. The ratio can be from about 6:1 to about 3:1, in some examples about 4:1.

The resin may comprise a polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less; said polymer may be a polymer having acidic side groups as described herein. The resin may comprise a first polymer having a melt viscosity of 15000 poise or more, in some examples 20000 poise or more, in some examples 50000 poise or more, in some examples 70000 poise or more; and in some examples, the resin may comprise a second polymer having a melt viscosity less than the first polymer, in some examples a melt viscosity of 15000 poise or less, in some examples a melt viscosity of 10000 poise or less, in some examples 1000 poise or less, in some examples 100 poise or less, in some examples 50 poise or less, in some examples 10 poise or less. The resin may comprise a first polymer having a melt viscosity of more than 60000 poise, in some examples from 60000 poise to 100000 poise, in some examples from 65000 poise to 85000 poise; a second polymer having a melt viscosity of from 15000 poise to 40000 poise, in some examples 20000 poise to 30000 poise, and a third polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less; an example of the first polymer is Nucrel 960 (from DuPont), and example of the second polymer is Nucrel 699 (from DuPont), and an example of the third polymer is AC-5120 or AC-5180 (from Honeywell). The first, second and third polymers may be polymers having acidic side groups as described herein. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate.

If the resin in the electrophotographic composition comprises a single type of polymer, the polymer (excluding any other components of the electrostatic composition) may have a melt viscosity of 6000 poise or more, in some examples a melt viscosity of 8000 poise or more, in some examples a melt viscosity of 10000 poise or more, in some examples a melt viscosity of 12000 poise or more. If the resin comprises a plurality of polymers all the polymers of the resin may together form a mixture (excluding any other components of the electrostatic composition) that has a melt viscosity of 6000 poise or more, in some examples a melt viscosity of 8000 poise or more, in some examples a melt viscosity of 10000 poise or more, in some examples a melt viscosity of 12000 poise or more. Melt viscosity can be measured using standard techniques. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate.

The resin may comprise two different polymers having acidic side groups that are selected from co-polymers of ethylene and an ethylenically unsaturated acid of either acrylic acid or methacrylic acid; or ionomers thereof, such as methacrylic acid and ethylene-acrylic or methacrylic acid co-polymers which are at least partially neutralized with metal ions (e.g. Zn, Na, Li) such as SURLYN® ionomers. The resin may comprise (i) a first polymer that is a co-polymer of ethylene and an ethylenically unsaturated acid of either acrylic acid and methacrylic acid, wherein the ethylenically unsaturated acid of either acrylic or methacrylic acid constitutes from 8 wt % to about 16 wt % of the co-polymer, in some examples 10 wt % to 16 wt % of the co-polymer; and (ii) a second polymer that is a co-polymer of ethylene and an ethylenically unsaturated acid of either acrylic acid and methacrylic acid, wherein the ethylenically unsaturated acid of either acrylic or methacrylic acid constitutes from 12 wt % to about 30 wt % of the co-polymer, in some examples from 14 wt % to about 20 wt % of the co-polymer, in some examples from 16 wt % to about 20 wt % of the co-polymer in some examples from 17 wt % to 19 wt % of the co-polymer.

The resin may comprise a polymer having acidic side groups, as described above (which may be free of ester side groups), and a polymer having ester side groups. The polymer having ester side groups may be a thermoplastic polymer. The polymer having ester side groups may further comprise acidic side groups. The polymer having ester side groups may be a co-polymer of a monomer having ester side groups and a monomer having acidic side groups. The polymer may be a co-polymer of a monomer having ester side groups, a monomer having acidic side groups, and a monomer absent of any acidic and ester side groups. The monomer having ester side groups may be a monomer selected from esterified acrylic acid or esterified methacrylic acid. The monomer having acidic side groups may be a monomer selected from acrylic or methacrylic acid. The monomer absent of any acidic and ester side groups may be an alkylene monomer, including, but not limited to, ethylene or propylene. The esterified acrylic acid or esterified methacrylic acid may, respectively, be an alkyl ester of acrylic acid or an alkyl ester of methacrylic acid. The alkyl group in the alkyl ester of acrylic or methacrylic acid may be an alkyl group having 1 to 30 carbons, in some examples 1 to 20 carbons, in some examples 1 to 10 carbons; in some examples selected from methyl, ethyl, iso-propyl, n-propyl, t-butyl, iso-butyl, n-butyl and pentyl.

The polymer having ester side groups may be a co-polymer of a first monomer having ester side groups, a second monomer having acidic side groups and a third monomer which is an alkylene monomer absent of any acidic and ester side groups. The polymer having ester side groups may be a co-polymer of (i) a first monomer having ester side groups selected from esterified acrylic acid or esterified methacrylic acid, in some examples an alkyl ester of acrylic or methacrylic acid, (ii) a second monomer having acidic side groups selected from acrylic or methacrylic acid and (iii) a third monomer which is an alkylene monomer selected from ethylene and propylene. The first monomer may constitute 1% to 50% by weight of the co-polymer, in some examples 5% to 40% by weight, in some examples 5% to 20% by weight of the co-polymer, in some examples 5% to 15% by weight of the co-polymer. The second monomer may constitute 1% to 50% by weight of the co-polymer, in some examples 5% to 40% by weight of the co-polymer, in some examples 5% to 20% by weight of the co-polymer, in some examples 5% to 15% by weight of the co-polymer. The first monomer can constitute 5% to 40% by weight of the co-polymer, the second monomer constitutes 5% to 40% by weight of the co-polymer, and with the third monomer constituting the remaining weight of the co-polymer. In some examples, the first monomer constitutes 5% to 15% by weight of the co-polymer, the second monomer constitutes 5% to 15% by weight of the co-polymer, with the third monomer constituting the remaining weight of the co-polymer. In some examples, the first monomer constitutes 8% to 12% by weight of the co-polymer, the second monomer constitutes 8% to 12% by weight of the co-polymer, with the third monomer constituting the remaining weight of the co-polymer. In some examples, the first monomer constitutes about 10% by weight of the co-polymer, the second monomer constitutes about 10% by weight of the co-polymer, and with the third monomer constituting the remaining weight of the co-polymer. The polymer may be selected from the Bynel® class of monomer, including Bynel 2022 and Bynel 2002, which are available from DuPont®.

The polymer having ester side groups may constitute 1% or more by weight of the total amount of the resin polymers, e.g. thermoplastic resin polymers, in the liquid electrophotographic composition, e.g. the total amount of the polymer or polymers having acidic side groups and polymer having ester side groups. The polymer having ester side groups may constitute 5% or more by weight of the total amount of the resin polymers, e.g. thermoplastic resin polymers, in some examples 8% or more by weight of the total amount of the resin polymers, e.g. thermoplastic resin polymers, in some examples 10% or more by weight of the total amount of the resin polymers, e.g. thermoplastic resin polymers, in some examples 15% or more by weight of the total amount of the resin polymers, e.g. thermoplastic resin polymers, in some examples 20% or more by weight of the total amount of the resin polymers, e.g. thermoplastic resin polymers, in some examples 25% or more by weight of the total amount of the resin polymers, e.g. thermoplastic resin polymers, in some examples 30% or more by weight of the total amount of the resin polymers, e.g. thermoplastic resin polymers, in some examples 35% or more by weight of the total amount of the resin polymers, e.g. thermoplastic resin polymers, in the liquid electrophotographic composition. The polymer having ester side groups may constitute from 5% to 50% by weight of the total amount of the resin polymers, e.g. thermoplastic resin polymers, in the liquid electrophotographic composition, in some examples 10% to 40% by weight of the total amount of the resin polymers, e.g. thermoplastic resin polymers, in the liquid electrophotographic composition, in some examples 5% to 30% by weight of the total amount of the resin polymers, e.g. thermoplastic resin polymers, in the liquid electrophotographic composition, in some examples 5% to 15% by weight of the total amount of the resin polymers, e.g. thermoplastic resin polymers, in the liquid electrophotographic composition in some examples 15% to 30% by weight of the total amount of the resin polymers, e.g. thermoplastic resin polymers, in the liquid electrophotographic composition.

The polymer having ester side groups may have an acidity of 50 mg KOH/g or more, in some examples an acidity of 60 mg KOH/g or more, in some examples an acidity of 70 mg KOH/g or more, in some examples an acidity of 80 mg KOH/g or more. The polymer having ester side groups may have an acidity of 100 mg KOH/g or less, in some examples 90 mg KOH/g or less. The polymer having ester side groups may have an acidity of 60 mg KOH/g to 90 mg KOH/g, in some examples 70 mg KOH/g to 80 mg KOH/g.

The polymer having ester side groups may have a melt flow rate of about 10 g/10 minutes to about 120 g/10 minutes, in some examples about 10 g/10 minutes to about 50 g/10 minutes, in some examples about 20 g/10 minutes to about 40 g/10 minutes, in some examples about 25 g/10 minutes to about 35 g/10 minutes.

The polymer, polymers, co-polymer or co-polymers of the resin can in some examples be selected from the Nucrel family of toners (e.g. Nucrel 403™, Nucrel 407™, Nucrel 609HS™, Nucrel 908HS™, Nucrel 1202HC™, Nucrel 30707™, Nucrel 1214™, Nucrel 903™, Nucrel 3990™, Nucrel 910™, Nucrel 925™, Nucrel 699™, Nucrel 599™, Nucrel 960™, Nucrel RX76™, Nucrel 2806™, Bynell 2002, Bynell 2014, Bynell 2020 and Bynell 2022, (sold by E. I. du PONT)), the Aclyn family of toners (e.g. Aclyn 201, Aclyn 246, Aclyn 285, and Aclyn 295), and the Lotader family of toners (e.g. Lotader 2210, Lotader, 3430, and Lotader 8200 (sold by Arkema)).

The resin can constitute about 5 to 90%, in some examples about 50 to 80%, by weight of the solids of the liquid electrophotographic composition. The resin can constitute about 60 to 95%, in some examples about 70 to 95%, by weight of the solids of the liquid electrophotographic composition.

Charge Adjuvant

The electrophotographic composition can include a charge adjuvant. A charge adjuvant may be present with a charge director, and may be different to the charge director, and act to increase and/or stabilise the charge on particles, e.g. resin-containing particles, of an electrostatic composition. The charge adjuvant can include, but is not limited to, barium petronate, calcium petronate, Co salts of naphthenic acid, Ca salts of naphthenic acid, Cu salts of naphthenic acid, Mn salts of naphthenic acid, Ni salts of naphthenic acid, Zn salts of naphthenic acid, Fe salts of naphthenic acid, Ba salts of stearic acid, Co salts of stearic acid, Pb salts of stearic acid, Zn salts of stearic acid, Al salts of stearic acid, Cu salts of stearic acid, Fe salts of stearic acid, metal carboxylates (e.g. Al tristearate, Al octanoate, Li heptanoate, Fe stearate, Fe distearate, Ba stearate, Cr stearate, Mg octanoate, Ca stearate, Fe naphthenate, Zn naphthenate, Mn heptanoate, Zn heptanoate, Ba octanoate, Al octanoate, Co octanoate, Mn octanoate, and Zn octanoate), Co lineolates, Mn lineolates, Pb lineolates, Zn lineolates, Ca oleates, Co oleates, Zn palmirate, Ca resinates, Co resinates, Mn resinates, Pb resinates, Zn resinates, AB diblock co-polymers of 2-ethylhexyl methacrylate-co-methacrylic acid calcium, and ammonium salts, co-polymers of an alkyl acrylamidoglycolate alkyl ether (e.g. methyl acrylamidoglycolate methyl ether-co-vinyl acetate), and hydroxy bis(3,5-di-tert-butyl salicylic) aluminate monohydrate. In some examples, the charge adjuvant is aluminium di and/or tristearate and/or aluminium di and/or tripalmitate.

The charge adjuvant can constitute about 0.1 to 5% by weight of the solids of the liquid electrophotographic composition. The charge adjuvant can constitute about 0.5 to 4% by weight of the solids of the liquid electrophotographic composition. The charge adjuvant can constitute about 1 to 3% by weight of the solids of the liquid electrophotographic composition.

Charge Director

A charge director may be added to the electrophotographic composition. In some examples, the charge director comprises nanoparticles of a simple salt and a salt of the general formula $MA_n$, wherein M is a barium, n is 2, and A is an ion of the general formula $[R_1—O—C(O)CH_2CH(SO_3^-)C(O)—O—R_2]$, where each of $R_1$ and $R_2$ is an alkyl group.

The sulfosuccinate salt of the general formula $MA_n$ is an example of a micelle forming salt. The charge director may be substantially free or free of an acid of the general formula HA, where A is as described above. The charge director may comprise micelles of said sulfosuccinate salt enclosing at least some of the nanoparticles. The charge director may comprise at least some nanoparticles having a size of 10 nm or less, in some examples 2 nm or more (e.g. 4-6 nm).

The simple salt may comprise a cation selected from Mg, Ca, Ba, $NH_4$, tert-butyl ammonium, $Li^+$, and $Al^{+3}$, or from any sub-group thereof. In one example, the simple salt is an inorganic salt, for instance, a barium salt. The simple salt may comprise an anion selected from $SO_4^{2-}$, $PO^{3-}$, $NO_3^-$, $HPO_4^{2-}$, $CO_3^{2-}$, acetate, trifluoroacetate (TFA), $Cl^-$, Bf, $F^-$, $ClO_4^-$, and $TiO_3^{4-}$, or from any sub-group thereof. In some examples, the simple salt comprises a hydrogen phosphate anion.

The simple salt may be selected from $CaCO_3$, $Ba_2TiO_3$, $Al_2(SO_4)_3$, $Al(NO_3)_3$, $Ca_3(PO_4)_2$, $BaSO_4$, $BaHPO_4$, $Ba_2(PO_4)_3$, $CaSO_4$, $(NH_4)_2CO_3$, $(NH_4)_2SO_4$, $NH_4OAc$, Tert-butyl ammonium bromide, $NH_4NO_3$, LiTFA, $Al_2(SO_4)_3$, $LiClO_4$ and $LiBF_4$, or any sub-group thereof. In one example, the simple salt may be $BaHPO_4$.

In the formula $[R_1—O—C(O)CH_2CH(SO_3^-)C(O)—O—R_2]$, in some examples, each of $R_1$ and $R_2$ is an aliphatic alkyl group. In some examples, each of $R_1$ and $R_2$ independently is a $C_{6-25}$ alkyl. In some examples, said aliphatic alkyl group is linear. In some examples, said aliphatic alkyl group is branched. In some examples, said aliphatic alkyl group includes a linear chain of more than 6 carbon atoms. In some examples, $R_1$ and $R_2$ are the same. In some examples, at least one of $R_1$ and $R_2$ is $C_{13}H_{27}$.

In an electrophotographic composition, the charge director can constitute about 0.001% to 20%, in some examples 0.01 to 20% by weight, in some examples 0.01 to 10% by weight, in some examples 0.01 to 1% by weight of the solids of the electrostatic composition. The charge director can constitute about 0.001 to 0.15% by weight of the solids of the liquid electrophotographic composition, in some examples 0.001 to 0.15%, in some examples 0.001 to 0.02% by weight of the solids of the liquid electrophotographic composition. In some examples, the charge director imparts a negative charge on the electrostatic composition. The particle conductivity may range from 50 to 500 pmho/cm, in some examples from 200-350 pmho/cm.

Carrier Liquid

The carrier liquid for the liquid electrophotographic composition can act as a dispersing medium for the other components in the electrostatic composition. For example, the carrier liquid can comprise or be a hydrocarbon, silicone oil, vegetable oil, etc. The carrier liquid can include, but is not limited to, an insulating, non-polar, non-aqueous liquid that can be used as a medium for toner particles. The carrier liquid can include compounds that have a resistivity in excess of about $10^9$ ohm-cm. The carrier liquid may have a dielectric constant below about 5, in some examples below about 3. The carrier liquid can include, but is not limited to, hydrocarbons. The hydrocarbon can include, but is not limited to, an aliphatic hydrocarbon, an isomerized aliphatic hydrocarbon, branched chain aliphatic hydrocarbons, aromatic hydrocarbons, and combinations thereof. Examples of the carrier liquids include, but are not limited to, aliphatic hydrocarbons, isoparaffinic compounds, paraffinic compounds, dearomatized hydrocarbon compounds, and the like. In some examples, the carrier liquid is an isoparaffinic liquid. In particular, the carrier liquids can include, but are not limited to liquids sold under the trademarks, Isopar-G™, Isopar-H™, Isopar-L™, Isopar-MT™, Isopar-K™, Isopar-V™, Norpar 12™, Norpar 13™, Norpar 15™, Exxol D40™, Exxol D80™, Exxol D100™, Exxol D130™, and Exxol D140™ (each sold by EXXON CORPORATION); Teclen N-16™, Teclen N-20™, Teclen N-22™, Nisseki Naphthesol L™, Nisseki Naphthesol M™, Nisseki Naphthesol H™, #0 Solvent L™, #0 Solvent M™, #0 Solvent H™, Nisseki Isosol 300™, Nisseki Isosol 400™, AF-4™, AF-5™, AF-6™ and AF-7™ (each sold by NIPPON OIL CORPORATION); IP Solvent 1620™ and IP Solvent 2028™ (each sold by IDEMITSU PETROCHEMICAL CO., LTD.); Amsco OMS™ and Amsco 460™ (each sold by AMERICAN MINERAL SPIRITS CORP.); and Electron, Positron, New II, Purogen HF (100% synthetic terpenes) (sold by ECOLINK™).

Before printing, the carrier liquid can constitute about 20% to 99.5% by weight of the electrostatic composition, in some examples 50% to 99.5% by weight of the electrostatic composition. Before printing, the carrier liquid may constitute about 40 to 90% by weight of the electrostatic composition. Before printing, the carrier liquid may constitute about 60% to 80% by weight of the electrostatic composition. Before printing, the carrier liquid may constitute about 90% to 99.5% by weight of the electrostatic composition, in some examples 95% to 99% by weight of the electrostatic composition.

The composition when printed on the print substrate, may be substantially free from carrier liquid. In an electrostatic printing process and/or afterwards, the carrier liquid may be removed, e.g. by an electrophoresis processes during printing and/or evaporation, such that substantially just solids are transferred to the print substrate. Substantially free from carrier liquid may indicate that the ink printed on the print substrate contains less than 5 wt % carrier liquid, in some examples, less than 2 wt % carrier liquid, in some examples less than 1 wt % carrier liquid, in some examples less than 0.5 wt % carrier liquid. In some examples, the ink printed on the print substrate is free from carrier liquid.

Colorants

Colorants may be absent from the transparent electrophotographic ink composition used as the first ink. However, where the second ink composition is an electrophotographic ink composition, the second ink may include a colorant. The colorant may be selected from a pigment, dye and a combination thereof. The colorant may be selected from a cyan colorant, a yellow colorant, a magenta colorant and a black colorant. The colorant may be selected from a phthalocyanine colorant, an indigold colorant, an indanthrone colorant, a monoazo colorant, a diazo colorant, inorganic salts and complexes, dioxazine colorant, perylene colorant, anthraquinone colorants, and any combination thereof.

Where present, the colorant may be present in an amount of 0.1 to 10 weight %, for instance, 2 to 5 weight % of the total weight of solids of the composition.

Solid Polar Compound

The transparent electrophotographic ink composition may further comprise a solid polar compound. In some examples, the solid polar compound is a solid (e.g., at room temperature, i.e., from about 20° C. to about 25° C.), colourless organic material. The solid organic material may be a polymeric material or a non-polymeric material. The solid polar compound may be an organic particle that is resistant to swelling or dissolving in a non-polar carrier fluid, e.g. an iso-paraffinic fluid. The solid polar compound may be dispersed in the resin, and, in some examples, is present in an amount up to 60 wt % of solids in the transparent electrostatic ink composition. The solid polar compound may be selected from the group consisting of a saccharide, polyacrylic acid, polyvinyl alcohol, styrene maleic anhydride, a bismaleimide oligomer, a cellulose derivative and an aliphatic urethane acrylate.

In some examples, the transparent electrophotographic ink composition comprises a saccharide or a modified saccharide. In some examples, modified saccharides are acetylated saccharides. In some examples, the transparent electrostatic ink composition comprises a disaccharide or a modified disaccharide. In some examples, the transparent electrostatic ink composition comprises a saccharide or modified saccharide selected from maltose monohydrate, sucrose, sucrose octanoate, sucrose octaacetate, dextrin, xylitol and sucrose benzoate.

In one example, the saccharide or modified saccharide is maltose monohydrate.

In some examples, the transparent electrostatic ink composition comprises a saccharide or a modified saccharide in an amount of greater than 15 wt % of the non-volatile solids in the electrostatic ink composition, for example, in an amount of greater than 20 wt % of the non-volatile solids in the transparent electrostatic ink composition, for example in an amount of greater than 25 wt % of the non-volatile solids in the transparent electrostatic ink composition, for example in an amount of greater than 30 wt % of the non-volatile solids in the transparent electrostatic ink composition. In some examples, the transparent electrostatic ink composition comprises a saccharide or a modified saccharide in an amount of less than 60 wt % of the non-volatile solids in the transparent electrostatic ink composition, for example less than 50 wt % of the non-volatile solids in the electrostatic ink composition, for example less than 45 wt % of the non-volatile solids in the transparent electrostatic ink composition, for example less than 40 wt % of the non-volatile solids in the transparent electrostatic ink composition.

In one example, the transparent electrostatic ink composition comprises a saccharide or a modified saccharide in an amount of 20 to 60 weight % of the non-volatile solids of the transparent electrophotographic ink composition, for example, 25 to 45 weight %.

In some examples, the solid polar compound has a particle size from about 30 nm to about 300 nm.

Examples of commercially available styrene maleic anhydrides include copolymers from Sartomer Co. USA, LLC, such as SMA® 4000I, SMA® 1000I, and SMA® 1000P. Examples of cellulose derivatives include sodium carboxylmethyl cellulose and cellulose acetate propionate. A suitable example of a bismaleimide oligomer is bis-stearamide, and a suitable example of an aliphatic urethane acrylate is REAFREE® UV ND-2335 from Arkema, Spain. It is to be understood that these solid polar compounds are examples, and that any other organic material that includes polar atoms and is resistant to swelling or dissolving in a non-polar carrier fluid may be used.

Transparent Electrophotographic Ink Composition

In one example, the transparent electrophotographic ink composition comprises a liquid carrier and a thermoplastic resin. In some examples, the transparent electrophotographic ink composition also comprises a solid polar compound. The liquid carrier may be an iso-paraffinic carrier. The thermoplastic resin may comprise an ethylene metharcrylic acid copolymer and/or an ethylene acrylic acid copolymer. In some examples, the thermoplastic resin comprises an ethylene methacrylic acid copolymer and an ethylene acrylic acid co-polymer in a ratio of 10:1 to 1:1, for example, 5:1 to 3:1, for instance, 4:1. The solid polar compound may be a saccharide, for example, maltose monohydrate. An example of a suitable transparent electrophotographic ink composition is sold under the trademark HP Indigo ElectroInk® Primer.

The transparent electrophotographic ink may be devoid of colorant. For example, it may contain 0 to less than 0.5 weight % colorant, for instance, 0 to less than 0.1 or 0.01 weight % colorant based on the total weight of solids in the composition.

In some examples, once printed, the transparent electrostatic ink composition forms a layer of less than 10 μm in thickness, for example less than 9 μm in thickness, less than 8 μm in thickness, less than 7 μm in thickness, less than 6 μm in thickness, less than 5 μm in thickness, less than 4 μm in thickness, less than 3 μm in thickness, less than 2 μm in thickness, less than 1.5 μm in thickness. In some examples, the transparent electrostatic ink composition is about 1 μm in thickness.

In some examples, once printed, the transparent electrostatic ink composition forms a layer greater than 0.1 μm in thickness, for example greater than 0.2 μm in thickness, greater than 0.3 μm in thickness, greater than 0.4 μm in thickness, greater than 0.5 μm in thickness, greater than 0.6 μm in thickness, greater than 0.7 μm in thickness, greater than 0.8 μm in thickness, greater than 0.9 μm in thickness. In some examples, the film of material is 0.1 to 5 μm thick, for example, 0.3 to 2 μm thick. In some examples, the film may be 0.5 to 1.5 μm thick.

When printed on the substrate, the transparent electrophotographic ink composition may form a relatively weak bond with the substrate, allowing the transparent electrophotographic ink composition to be conveniently removed. For example, once printed, the transparent electrophotographic ink composition may be removed from the substrate by peeling or scraping. In one example, the composition may be removed by applying an adhesive tape over the printed ink and then peeling the tape from the substrate's surface.

In other examples, the transparent electrophotographic ink composition may be removed by heat transfer. The bond between the transparent electrophotographic composition and the substrate may be weakened by application of heat e.g. as the resins in the transparent electrophotographic ink soften or melt.

Primer

As discussed above, a primer may be applied to at least the areas of substrate that are not imprinted with the transparent electrophotographic ink composition. In some examples, the primer is also applied over the transparent electrophotographic ink composition.

Any suitable primer may be used in the process of the present disclosure. Suitable primers include polymeric primers, for example, comprising a polymer and a solvent. In some examples, the primer comprises a polymer emulsion. Suitable solvents include aqueous solvents, for example, water. The concentration of polymer in the solvent may be 5 to 30 weight %, for example, 10 to 15 weight %.

In some examples, the primer may be selected from ethylene acrylic/methacrylic acid or acrylate/methacrylate copolymer emulsions, ethylene acrylic ionomers (saponified acrylic acid), polyamides, polyurethanes, polyamines, polyethylene imines, ethylene vinyl alcohol and ethylene vinyl acetate copolymer emulsions. The primer may also comprise a polymer comprising a polar group. Examples of polar groups include sulfonic, phosphonic, anhydride and silane groups.

In one example, a primer coating comprising a mixture of: a) about 60 to 95% by weight of a copolymer of ethylene and acrylic or methacrylic acid in an aqueous dispersion containing from about 10 to about 40% by weight total solids; and b) about 10 to 40% by weight of an adhesion enhancer comprising a hydrogenated rosin or rosin ester. Examples of such primers are described in U.S. Pat. No. 8,198,353. In one example, the primer comprises polyethylene imine. In one example, the primer comprises a 1 to 30 weight % (e.g. 5 to 20 weight %) polyethylene imine dissolved in water. In some examples, the primer is a primer sold under the trademark Michelman® DP050 and Michelman® DP030.

The primer may also include at least one of crosslinkers, antifoaming agents, levelling (wetting) agents, and anti-blocking agents.

The primer may be applied as a layer in an amount of 0.01 to 5 $g/m^2$ of substrate, for example, 0.02 to 3 $g/m^2$ of substrate. In one example, the primer is applied in an amount of 0.03 to 1.5 $g/m^2$ of substrate, for example, 0.04 to 1 $g/m^2$ of substrate. In one example, the primer is applied in an amount of 0.05 to 0.8 $g/m^2$ of substrate, for example, 0.1 to 0.5 $g/m^2$ of substrate.

The primer may be applied using any suitable method, including painting, dipping, spreading and gravure coating. In one example, the primer is applied by mechanical means and is not digitally printed.

In some examples, the primer is an analogue primer that is not suitable for electrophotographic printing. For example, the primer may be devoid of charge adjuvant and/or charge director. The primer may be a non-selective analogue primer, as it cannot be targeted onto selected areas of the substrate by digital printing.

Print Substrate

The process of the present disclosure may be used to print any suitable substrate. The substrate (e.g. the substrate or further substrate) may be a polymer. In some examples, the substrate (e.g. the substrate or further substrate) is a flexible substrate. In some examples, the substrate (e.g. the substrate or further substrate) is a polymer film. In some examples, the substrate (e.g. the substrate or further substrate) is a paper film. In some examples, the substrate may be fabric. The substrate may additionally include metal, for example, as a coating or support layer.

In some examples, the substrate may be formed of a polymer selected from polyethylene (PE), linear low density polyethylene (LLDPE), low density polyethylene (LDPE), polypropylene (PP), biaxially oriented polypropylene (BOPP), polyethylene terephthalate, polyamide, biaxially oriented polyamide, and polyvinyl chloride.

Once printed, the substrate may be processed and formed into a variety of articles, including flexible packaging. In one example, the substrate may be formed into a shrink sleeve.

The printed substrates may be laminated, bonded or sealed. In one example, a portion of substrate is bonded to another portion of substrate to form a seam or seal. A solvent, for example, THF may be used to aid in seam or bond formation. The wetting characteristics of the substrate may be unaffected by the presence of exposed primer on the substrate's surface.

In some examples, the substrate comprises a film of material, wherein the film is less than 100 μm in thickness, for example less than 90 μm in thickness, less than 80 μm in thickness, less than 70 μm in thickness, less than 60 μm in thickness, less than 50 μm in thickness, less than 40 μm in thickness, less than 30 μm in thickness, less than 20 μm in thickness, less than 15 μm in thickness. In some examples, the film of material is about 12 μm in thickness.

In some examples, the substrate comprises a film of material, wherein the film is greater than 12 μm in thickness, for example greater than 15 μm in thickness, greater than 20 μm in thickness, greater than 30 μm in thickness, greater than 40 μm in thickness, greater than 50 μm in thickness, greater than 60 μm in thickness, greater than 70 μm in thickness, greater than 80 μm in thickness, greater than 90 μm in thickness. In some examples, the film of material is about 100 μm in thickness.

Prior to printing the transparent electrophotographic ink onto the substrate, the substrate may be treated by corona treatment.

Electrophotographic Printing

As described above, the transparent electrophotographic ink composition may be electrophotographically printed onto the substrate. Any electrophotographic ink composition used as the second ink composition may also be electrophotographically printed onto the primer layer on the substrate. The electrophotographic printing method may comprise forming a latent electrophotographic image on a surface. The surface may then be contacted with the electrophotographic ink composition, such that at least some of the electrophotographic ink composition adheres to the surface to form a developed toner image on the surface. The toner image is then transferred to the substrate, in some examples via an intermediate transfer member. The electrophotographic ink composition used in the printing process printing may comprise toner particles comprising, for example, thermoplastic resin, charge adjuvant and/or a charge director. In the case of the second ink composition, the toner particles may additionally include a colorant. In the case of the transparent electrophotographic ink composition, the toner particles may additionally include a solid polar compound.

Thermal Transfer

As mentioned above, the transparent electrophotographic ink may be removed from the selected areas of the substrate (together with any overlying primer and/or second ink composition in those areas) by thermal or heat transfer. This may involve contacting the printed substrate with a further substrate. Heat and pressure may be applied so as to transfer the transparent electrophotographic ink and any overlying primer or second ink onto the further substrate. The heating step may help to soften or melt any thermoplastic resin in the printed transparent electrophotographic ink composition, facilitating transfer from the substrate. The contacting may be carried out on a lamination apparatus or a pressure sealer, which are commercially available. When the substrate and further substrate are subsequently separated, the further substrate may be imprinted with an image formed of the transparent electrophotographic ink and any primer or second ink that previously overlaid the transparent electrophotographic ink layer on the initial substrate.

The contacting may be carried out at a suitable temperature to allow the thermoplastic resin to soften or become molten during the contacting. The temperature may be an elevated temperature, e.g. of 30° C. or above, in some examples 40° C. or above, in some examples 50° C. or above, in some examples 60° C. or above, 70° C. or above, 80° C. or above, in some examples 100° C. or above, in some examples 150° C. or above, in some examples 180° C. or above. The suitable temperature may be from 30° C. to 100° C., in some examples 30° C. to 80° C. in some examples 30° C. to 70° C., in some examples 40° C. to 80° C. The suitable temperature may be from 50° C. to 250° C., in some examples from 60° C. to 220° C., in some examples from 90° C. to 210° C., in some examples from 90 to 130° C., in some examples from 100 to 110° C. The substrate and the further substrate may be separated while the thermoplastic resin is softened or molten.

The temperature may be a temperature at or above the Vicat softening point of the resin, as measured using ASTM D1525. The temperature may be a temperature at or above the freezing point of the resin, as measured by Differential Scanning calorimetry under ASTM D3418. The temperature may be a temperature at or above the melting point of the resin, as measured by Differential Scanning calorimetry under ASTM D3418. Where a plurality of polymers are used in the resin, the softening point, freezing point or the melting point, may be measured on the blend of polymers.

The contacting may involve pressing the substrates between two members, at least one of which, in some examples both of which, is/are heated, e.g. to a temperature mentioned above. In some examples, the two members may be heated to the same temperature, e.g. to a temperature mentioned above. In some examples, the two members may be heated to different temperatures, e.g. one at a temperature of from 40° C. to 100° C., e.g. 40° C. to 70° C., and the other at a higher temperature, e.g. a temperature of 100° C. or more, e.g. a temperature of from 110° C. to 250° C., e.g. a temperature of from 110° C. to 150° C. In some examples, at least one of the members is heated to a temperature of 100° C. or above. The two members may be rollers, and may be part of a lamination apparatus. If the two members are rollers, the speed of passing the target substrate and the transfer material (having the transparent electrostatic image and the image there between) through the rollers may be a suitable speed to allow the resin of the transparent electrostatic ink composition to soften or melt. The speed may be at least 0.1 m/min, in some examples at least 0.5 m/min, in some examples at least 1 m/min. The speed may be at least 10 m/min or less, in some examples 5 m/min or less, in some examples 4 m/min or less, in some examples 3 m/min or less. The speed may be of from 0.1 m/min to 10 m/min, in some examples from 0.5 m/min to 5 m/min, in some examples 0.5 m/min to 4 m/min, in some examples 1 m/min to 3 m/min. The speed may be determined depending on the temperature of the rollers, with a higher temperature leading to faster softening or melting of the resin, allowing for a higher speed, since the contact time can be less.

Pressure may be applied to the transfer material and the target substrate during the contacting, e.g. at the temperatures mentioned above. The pressure may be a pressure of at least from 1 bar (100 kPa), in some examples at least 2 bar, in some examples from 1 bar to 20 bar, in some examples 2 bar to 10 bar, in some examples 2 bar to 5 bar, in some examples, 5 bar to 10 bar.

The contacting under a raised temperature and, in some examples, under pressure, may be carried out for a suitable time period to effect adhesion onto the further substrate. The suitable time period may be selected at least 0.1 seconds, in some examples at least 0.2 seconds, in some examples at least 0.5 seconds, in some examples at least 0.8 seconds, in some examples at least 1 second, in some examples at least 1.2 seconds, in some examples at least 1.5 seconds, in some examples at least 1.8 seconds, in some examples at least 2 seconds. The suitable time may be from 0.1 seconds to 10 seconds, in some examples 0.5 seconds to 5 seconds.

EXAMPLES

In the following examples, 'Isopar' is Isopar™ L Fluid, produced by ExxonMobil and having CAS Number 64742-48-9.

In the following examples, the resin used is Nucrel 699, available from DuPont, and A-C 5120, available from Honeywell, in a weight ratio of 4:1.

In the following examples, NCD indicates a natural charge director made of three components: KT (natural soya lecithin in phospholipids and fatty acids), BBP (basic barium petronate i.e. a barium sulfonate salt of a 21-26 hydrocarbon alkyl, supplied by Chemtura®), and GT (dodecyl benzene sulfonic acid isopropyl amine, supplied by Croda®). The composition being 6.6 wt % KT, 9.8 wt % BBP and 3.6 wt % GT, balance 80% Isopar.

In the following examples, SCD indicates a synthetic charge director, being a barium bis sulfosuccinate salt as described in US 2009/0311614 or WO2007130069. This is a strong negative charge director with strong base in the micelle core (barium phosphate) which enhances stable negative charge on ink particle. SCD is a charge director and in the absence of a dispersant) has been found to display very low field charging (high charge partitioning).

Example 1

In this Example, a transparent electrophotographic ink composition was prepared. The composition was formed as a paste (73.14 g) containing 35 wt % solids dispersed in Isopar. The solids included 65 weight % resin (a 4:1 mixture of Nucrel® 699 (DuPont) and A-C 5120 (Honeywell)); 35 wt % maltose monohydrate (Fisher) and 1.0 wt % aluminium stearate (charge adjuvant, Sigma Aldrich) based on the total weight of solids in the paste. The paste was ground using an attritor (S0 from union process USA) at 25° C. for 24 hours. The paste was then diluted to 2 wt % solids in Isopar, and charged by adding 8 ml of NCD solution to 2 kg of working ink solution.

Example 2

A biaxially oriented polypropylene (BOPP) film substrate (Treofan®) was treated using corona discharge (1 kW). The transparent electrophotographic ink composition prepared in Example 1 was electrophotographically printed over the treated film substrate using an HP Indigo 6600 printing system. The printed layer was approximately 1 μm thick.

A non-selective analogue primer (10 weight % polyethylene imine in water, DP050 Michelman) was then applied over the printed transparent electrophotographic ink by gravure coating (approximately 0.2 g/m$^2$). The primer was allowed to dry. Once dried, a liquid cyan electrophotographic ink (HP Indigo® Cyan) was printed over the primer using an HP Indigo 6600 printing system (approximately 1 μm thick).

Example 3

In this Example, various properties of the substrate of Example 2 were tested.

Bond Strength

A piece of adhesive tape (Tape 810 scotch, 3M) was placed over the top of the printed surface of the substrate of Example 2. A 2 kg rubber roller was rolled over the back of adhesive tape to enhance adhesion between the adhesive tape and the substrate. The adhesive tape was then peeled away from the substrate. A seal was formed between the exposed portion of the substrate and an untreated portion of the initial biaxially oriented polypropylene (BOPP) film substrate (Treofan®). The seal was formed using a semi-automatic sealing machine (Sealer Brugger HSC-s). The bond strength was measured using an Instron 210 Family Electromechanical Universal Test Machine.

The bond strength of the seal was determined to be 2.7-3.8 lbsN/inch

Presence of Primer

A piece of adhesive tape (Tape 810 scotch, 3M) was placed over the top of the printed surface of the substrate of Example 2. A 2 kg rubber roller was rolled over the back of adhesive tape to enhance adhesion between the adhesive tape and the substrate. The adhesive tape was then peeled away from the substrate. The exposed surface of the substrate was analysed (using a pH indicator) to determine the presence of residual primer. No primer was detected.

Thermal Transfer Quality

The printed surface of the substrate of Example 2 was contacted with a paper film (Condat 130 gr) to determine the efficacy of thermal transfer of the printed image. Thermal transfer to the paper film was performed using a laboratory laminator (from GMP, model EXCELAM PLUS 355RM). The paper film was placed on the top of the printed surface of the substrate of Example 2 prior to thermal transfer of the image to the paper film. The substrate and paper film were passed through a two heated-roll laminator where the printed substrate of Example 2 was heated by the top roll to 120° C.: the bottom paper film was heated to 50° C. by the bottom roll. The foil speed was 1.9 m/min and the pressure was set up to maximum.

The transparent electrophotographic ink originally present on the printed substrate of Example 2 was completely released from the substrate's surface and the printed image originally present on the substrate of Example 2 was transferred onto the paper film.

Comparative Example 4

The tests outlined in Example 3 were repeated on comparative substrates. Sample A was an untreated biaxially oriented polypropylene (BOPP) film substrate (Treofan®) used at the starting substrate in Example 2.

In Sample B, the biaxially oriented polypropylene (BOPP) film substrate (Treofan®) was a corona-treated (1 kW) and primed with a layer (approximately 0.2 g/m$^2$) of non-selective analogue primer (DP050 Michelman) by gravure coating.

Sample C was identical to the printed substrate of Example 2 except that the primer layer was left exposed. In other words, a layer of cyan electrophotographic ink was not printed over the primer layer.

The Table below compares the properties of the substrate of Example 2 with Samples A, B and C. It can be seen that the bond strength achieved with the printed substrate of Example 2 approaches that of the untreated substrate of Sample A. The bond strength of Example 2 is superior to that achieved in Samples B and C. It can also be seen that the coating layer(s) can be removed from the substrate in Example 2 without any detectable primer left on the substrate's surface. With Samples B and C, on the other hand, residual primer was detected. The printed layer(s) on the substrate of Example 2 could also be effectively transferred by thermal transfer. In contrast, the layers on the substrates of Samples B and C could not be thermally transferred as effectively. Surprisingly, the presence of the second ink layer (HP Indigo® Cyan) facilitated release of the printed layer in Example 2. This is reflected by the improvements observed in Example 2 over Sample C.

| Sample | Bond strength [lbs N/inch] | Presence of primer | Thermal transfer quality |
|---|---|---|---|
| A | 5 | N/A | N/A |
| B | 0.75-1.2 | full coverage | no transfer |
| C | 0.5-1.0 | partial coverage | partial transfer |
| Example 2 | 2.7-3.8 | no indication for primer presence | complete transfer |

The invention claimed is:

1. A process for selectively printing an image onto a substrate, said process comprising electrophotographically printing a first ink composition onto selected areas of a substrate, wherein the first ink composition is a transparent electrophotographic ink composition, applying a primer over at least the unprinted areas of the substrate, printing a second ink composition onto the primer, and removing the first ink composition from the selected areas of the substrate.

2. A process as claimed in claim 1, wherein the primer coat is applied over unprinted areas of the substrate and over the first ink composition printed on the substrate.

3. A process as claimed in claim 2, wherein the first ink composition is removed from the selected areas of the substrate together with the primer and second ink composition covering the selected areas of substrate.

4. A process as claimed in claim 1, wherein the first ink composition is removed by:

contacting the substrate with a further substrate, and applying heat to transfer the first ink composition and any primer and/or second ink composition covering the selected areas of the substrate to the further substrate.

5. A process as claimed in claim 4, wherein, on application of heat, the second substrate becomes imprinted with an image comprising a layer of the second ink composition, a layer of primer disposed over the layer of the second ink composition and a layer of the first electrophotographic ink composition disposed over the layer of primer.

6. A process as claimed in claim 5, wherein the further substrate is formed from a polymeric film.

7. A process as claimed in claim 6, which further comprises bonding parts of the polymeric film of the substrate together, or bonding parts of the polymeric film of the further substrate together to form a seam.

8. A process as claimed in claim 4, wherein the further substrate is formed from a polymeric film.

9. A process as claimed in claim 8, which further comprises bonding parts of the polymeric film of the substrate together, or bonding parts of the polymeric film of the further substrate together to form a seam.

10. A process as claimed in claim 1, wherein the substrate is formed of a polymeric film.

11. A process as claimed in claim 10, which further comprises bonding parts of the polymeric film of the substrate together, or bonding parts of the polymeric film of the further substrate together to form a seam.

12. A process as claimed in claim 1, wherein the substrate is treated by corona discharge prior to electrophotographically printing the first electrophotographic ink composition onto the substrate.

13. A process as claimed in claim 1, wherein the second ink composition is an electrophotographic ink composition comprising a colorant.

14. A process as claimed in claim 1, wherein the first ink composition is a transparent electrophotographic ink composition comprising a thermoplastic resin.

15. A process as claimed in claim 1, wherein the transparent electrophotographic ink composition is devoid of colorant.

16. A process as claimed in claim 1, wherein the first ink composition and the second ink composition are liquid electrophotographic compositions comprising charge directors and/or charge adjuvants.

* * * * *